US006851285B1

(12) United States Patent
Haas

(10) Patent No.: US 6,851,285 B1
(45) Date of Patent: Feb. 8, 2005

(54) KEYLESS LOCKING DEVICE

(76) Inventor: David J. Haas, 9 Marget Anne La., Suffern, NY (US) 10901

( * ) Notice: Subject to any disclaimer, the term of this patent is extended or adjusted under 35 U.S.C. 154(b) by 0 days.

(21) Appl. No.: 10/672,525

(22) Filed: Sep. 29, 2003

(51) Int. Cl.[7] ..... E05B 37/06
(52) U.S. Cl. ..... 70/26; 70/34; 70/24
(58) Field of Search ..... 70/63, 22–26, 70/31–34

(56) References Cited

U.S. PATENT DOCUMENTS

| | | | | | |
|---|---|---|---|---|---|
| 254,284 | A | * | 2/1882 | Dean | 70/23 |
| 438,353 | A | * | 10/1890 | Masters | 70/4 |
| 457,959 | A | * | 8/1891 | Pursell | 70/22 |
| 465,450 | A | * | 12/1891 | Brooke | 70/26 |
| 488,648 | A | * | 12/1892 | Covington | 70/23 |
| 512,980 | A | * | 1/1894 | Lowrie | 70/25 |
| 601,034 | A | * | 3/1898 | Bradley | 70/24 |
| 940,762 | A | * | 11/1909 | Whalen | 70/25 |
| 1,181,790 | A | * | 5/1916 | Newman | 70/25 |
| 1,274,051 | A | * | 7/1918 | Jacobson | 70/23 |
| 1,472,206 | A | * | 10/1923 | Burkle | 70/30 |
| 2,018,745 | A | * | 10/1935 | Schlitz | 70/303 R |
| 3,264,851 | A | * | 8/1966 | Kimball | 70/312 |
| 3,597,945 | A | | 8/1971 | Feinberg | |
| 3,973,419 | A | * | 8/1976 | Atkinson | 70/68 |
| 4,139,084 | A | | 2/1979 | Linke | |
| 4,213,314 | A | | 7/1980 | Trader | |
| 4,262,718 | A | | 4/1981 | Stark | |
| 4,428,211 | A | * | 1/1984 | Hermann | 70/34 |
| 4,578,966 | A | | 4/1986 | Kasai | |
| 4,763,763 | A | | 8/1988 | Sadow | |
| 4,792,026 | A | | 12/1988 | Dimmick | |
| 5,063,760 | A | | 11/1991 | Horita | |
| 5,540,065 | A | * | 7/1996 | Wyers | 70/26 |
| 5,819,889 | A | * | 10/1998 | Shieh | 188/265 |
| 5,899,099 | A | * | 5/1999 | Tsai | 70/26 |
| 6,213,266 | B1 | | 4/2001 | Hollingsworth | |
| 6,295,702 | B1 | | 10/2001 | Bauer | |
| 6,382,280 | B1 | | 5/2002 | Sands | |

* cited by examiner

*Primary Examiner*—Suzanne Dino Barrett
(74) *Attorney, Agent, or Firm*—Michael E. Zall

(57) ABSTRACT

A locking device having a cylindrical plunger with a key thereon and a cylindrical sleeve for receiving the plunger and key. The sleeve has a lip therein with a mating keyway that passes therethrough. An indicium on the sleeve is aligned with the keyway. To lock the device the plunger is inserted into the sleeve, the key sliding along the keyway through the lip into the bottom portion compressing a spring member therein. The sleeve and plunger are then rotated with respect to each other and released, the spring biasing the plunger upward to lock the key onto the bottom surface of the lip. To unlock the device, the sleeve and plunger are pressed together and rotated with respect to each other until, by noting the position of the known indicium, the key and keyway are aligned with each other. The plunger is then removed from the sleeve.

13 Claims, 8 Drawing Sheets

KEYLESS LOCKING DEVICE

BACKGROUND OF THE INVENTION

1. Field of the Invention

The present invention relates to a keyless locking device, and in particular to a keyless combination type locking device which is easy to open by the user for use on handbags, knapsacks, pockets and the like to prevent pickpocketing.

2. Related Art

It is common knowledge that theft and crime are a continuing and every present problem to the general population. Pickpocket theft is a crime that has existed through the years, but in recent years has been increasing because of the value of non-monetary items such as credit cards, drivers license, etc. that are kept in wallets and carrying bags. It has also become more of a problem because of the miniaturization of items such as cell phones, PDA's, etc. Additionally, because there are more inexperienced travelers and tourists than ever, the skilled pick pocket has more opportunities to ply his or her skills.

In reviewing the crime of pickpocketing, women represent about 70% of the victims while men represent about 30% of the victims. More important, the crime in European countries is perpetrated on nonresidents of a country 10 times more frequently than those that reside in the particular country.

Women's handbags, backpacks, etc. are particularly susceptible to pickpockets because these bags usually contain money and other valuables making them targets by pickpockets. Handbags are very vulnerable to pickpockets because the handbag is often out-of-sight from the user and hence, presents an opportunity to pickpockets.

Locks for carrying cases particularly handbags, suitcases, briefcases, attaches, and the like are well known. It has been the goal of many inventors to provide adequate means for securing such carrying cases and bags to prevent their theft and/or the theft of their contents. Many handbag structures and attachable devices have been devised for this purpose.

Among the locking devices that are commonly used with these types of carrying cases are key locks, combination locks, barrel-type combination locks, and various latches that are used to open and close the carrying case, even though the carrying case may not be locked in a closed position. In addition to securing a handbag or a suitcase in a closed position, a number of efforts have been made to provide locking devices to secure the carrying case to a stationary object to prevent theft of the carrying case when unattended for a period of time. Although these devices may aid in preventing the theft of the bag or its contents, they are often difficult to close and to open by the user.

The applicant is aware of the following prior art:

U.S. Pat. No. 3,597,945 to Feinberg describes a latching device for use on luggage. The device includes a latch pivotally connected to the luggage that has a resiliently mounted, manually operable plug connected to the luggage for longitudinal sliding movement with respect thereto, cooperable means are provided by the latch and the plug to releasably connect the latch to the plug. The latch overlies the luggage and when latched provides a flat, continuous surface. A combination locking means is associated with the plug to releasably lock the plug in its latched position. The means for selecting or changing the combination is covered by the latch in the latched condition of the device. In the unlatched position of the latch, the means for changing the combination is exposed at the front of the device and on the same side that one views the dials of the combination locking means.

U.S. Pat. No. 4,139,084 to Linke describes hand luggage having a plurality of compartments, each of which can be separately opened by means of an outside opening control, and in which all the opening controls are grouped on a single panel.

U.S. Pat. No. 4,213,314 to Trader describes a locking device for a handbag in which one end of the carry strap has a lock bolt thereon which inserts into a lock attached to the handbag adjacent one end of the handbag's access opening. The opening for access into the handbag has a slide fastener with an annular handle through which the lock bolt may be passed when being inserted into the lock to lock closed the handbag. The lock is opened with a combination lock having a plurality of lock dials or a key.

U.S. Pat. No. 4,262,718 to Stark describes a non-locking closure for hand luggage, handbags and the like. In particular, a closure is described of the type wherein a strap is attached to the front of the bag and is passed through a link on the flap, folded back on itself, and detachably fastened to the front of the bag.

U.S. Pat. No. 4,578,966 to Kasai describes a locking system for a slide fastener (zipper) of the type having two sliders which act independently of one another for opening and closing a common slide fastener which can be locked together against movement away from each other in their fully closed position. The locking device is mounted on the first pull tab and includes a bolt lockingly engageable with a recess in the projection of said second slider.

U.S. Pat. No. 4,763,763 to Sadow describes a convertible carrying handle and shoulder strap for hand luggage.

U.S. Pat. No. 4,792,026 to Dimmick et al. describes a carrying case having a zipper-type closure element which includes a pair of spaced apart pockets for receiving a cylindrical locking device. The locking device has a lockable safety pin pivotal into and out of a closed position with a lock element. The locking device is retained in the pockets. The pin in the open position engages the closure element and is pivoted to the closed position to prevent movement of the closure element to open the carrying case. A length of strap extending from the case may be wrapped around a stationary object and secured to the closed pin to prevent theft of the carrying case.

U.S. Pat. No. 5,063,760 to Horita, et al. describes a keyless combination or dial lock locking device for use on slide fasteners and other closure articles for security purposes. The lock comprises a male part and a female part interengageable therewith, the male part having a plunger adapted to move into and out of the female part, a lock tumbler pivotally engageable with the plunger and, a rotary means operatively associated with the lock tumbler and frictionally driven by a plurality of dials carrying indicia thereon such as numerical figures, the combination of which being selected to lock and unlock the assembly.

U.S. Pat. No. 6,213,266 to Hollingsworth describes a wheeled flight bag having wheels on a bottom wall of the case and a retractable handle for pulling the case along on the wheels. The flight bag includes an externally mounted, removable carrying case for securely transporting a delicate instrument such as a laptop computer which may be secured thereon with a combination lock.

U.S. Pat. No. 6,295,702 to Bauer describes a magnetically actuated locking system for securely locking together the male and female elements of a fastener until released by manual movement of a release. The mechanism has particular utility for handbags and cases, and can be used for mechanically securing two opposing surfaces that can be brought into aligned superposed position while allowing access to the sliding lock release mechanism.

U.S. Pat. No. 6,382,280 to Sands describes a purse whose exterior appearance can be transformed to suit a variety of different formal and informal occasions. The purse comprises a frame and a cover defining an enclosure that is sized to fit around the frame, the frame being removable from the cover.

OBJECTS AND SUMMARY OF THE INVENTION

It is an object of this invention to provide a keyless locking device, particularly useful with handbags, which is easy to open by the user and prevents casual entry by pickpockets into the bag.

It is a further object of this invention to provide a keyless locking device, similar to a combination lock, that will prevent accidental or casual opening of the device without prior knowledge of the manner in which it is opened.

It is another object of this invention to provide a locking device for handbags that requires no key to open and only requires the user to remember only one number or indicium to open, thus relieving the user of the anxiety of remembering a combination of numbers as with known combination locks.

It is another object of this invention to provide a locking device that is small and attractive and does not require a key.

Another object of the invention is to provide a locking device for a portable receptacle which may be permanently affixed to the receptacle.

All of the foregoing objects of this invention and others are achieved by the keyless locking device of this invention. The device comprises a cylindrical plunger having a near end and a distal end and a key thereon. The key is at a prescribed distance from the near end and at an axial location on the circumference of the plunger. The device further has a cylindrical sleeve for releasably and rotatably receiving the plunger. The sleeve has an open top portion, a bottom portion and a circumferential lip within the sleeve separating the top and bottom portions. The lip has a bottom surface. A keyway is provided in the sleeve and is axially disposed therein. The keyway passes through the top portion of the sleeve and through the lip. The key on the plunger slidably mates with the keyway.

In one preferred embodiment, indicia are circumferentially disposed about the sleeve, whereas in another embodiment indicia are circumferentially disposed about the near end of the plunger. In the first embodiment where the indicia are on the sleeve, a known indicium is substantially axially aligned with the location of the keyway. In the second embodiment, where the indicium is on the plunger, a known indicium is axially aligned with the location of the key.

On the plunger, the distance between the key and the near end of the plunger is sufficient: to permit the key to extend into the bottom member below the lip and maintain the near end of the plunger outside the sleeve. A spring member is provided within the bottom portion of the sleeve and is compressed hen in contact with the distal end of the plunger, biasing the plunger upward.

In order to lock the device, the plunger is inserted into the sleeve, the key sliding along the keyway through the lip into the bottom portion, the distal end compressing the spring member. Subsequently, the sleeve and plunger are rotated with respect to each other and released. The spring then biases the plunger upward and locks the key onto the bottom surface of the lip. Optionally, the bottom of the surface has a plurality of key grooves that mate with the key to hinder rotation of the plunger with respect to the sleeve. In order to unlock the device, the sleeve and plunger are pressed together and rotated with respect to each other until the key and keyway are aligned with each other by noting the position of the known indicium with the keyway or key. The plunger is then removed from the sleeve, the key sliding along the keyway through the lip and into the top portion of the sleeve.

The locking device may, for example, be conveniently used to lock a handbag in the closed position by attaching one of the sleeve or plunger to the zipper grasp and the other to the handbag near the position the grasp is in when the zipper is closed. Optionally, either the plunger or sleeve may be permanently affixed to the device to be locked.

BRIEF DESCRIPTION OF THE DRAWINGS

Other important objects and features of the invention will be apparent from the following Detailed Description of the Invention taken in connection with the accompanying drawings in which.

DETAILED DESCRIPTION OF THE INVENTION

In all of the embodiments depicted the numbers depicted for like elements are the same.

Figure 1:
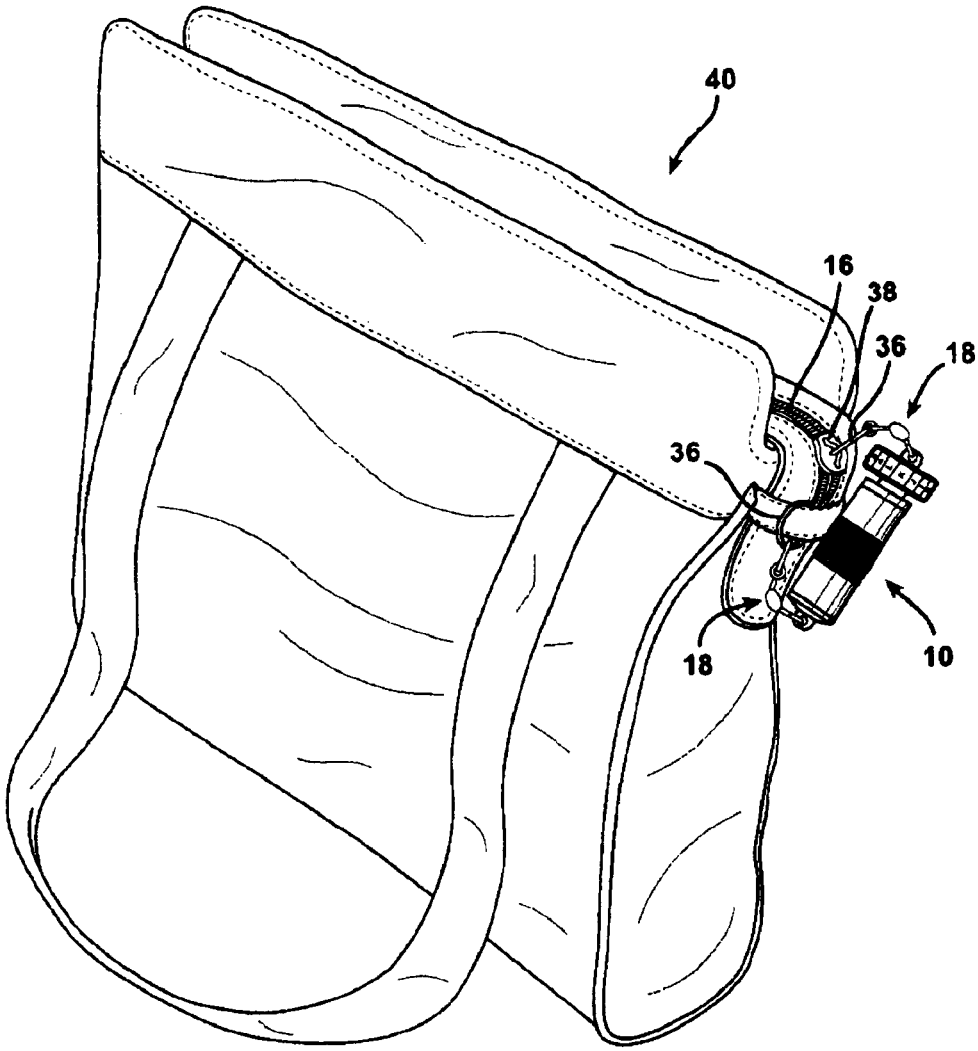
FIG. 1 is a perspective view of one embodiment of the keyless locking device 10 in use on a zippered handbag 40.
Figure 11:
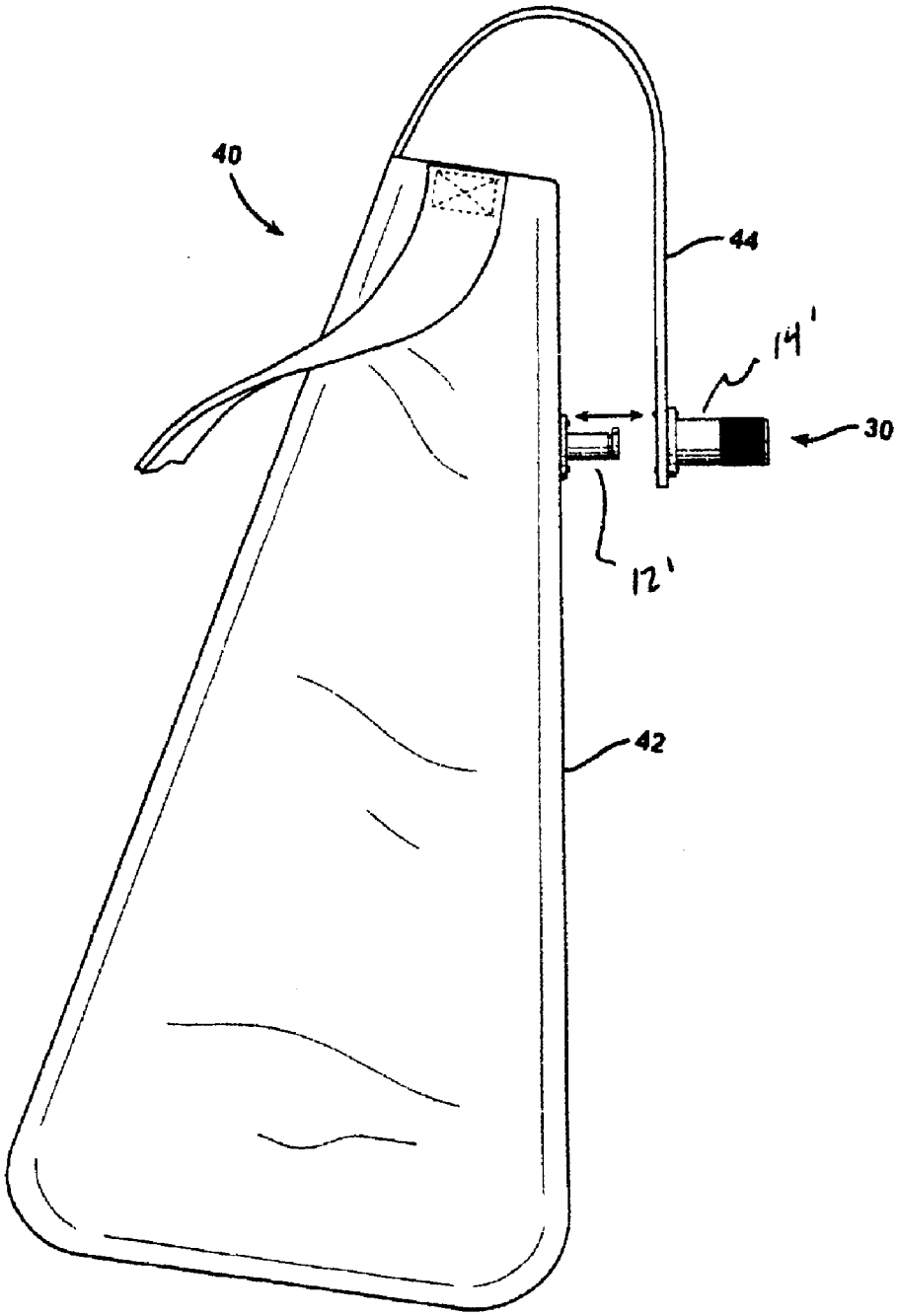
FIG. 11 is a side view of a second embodiment of the keyless locking device 30 in use on a handbag 40 having a closure flap 44.
Figure 13:
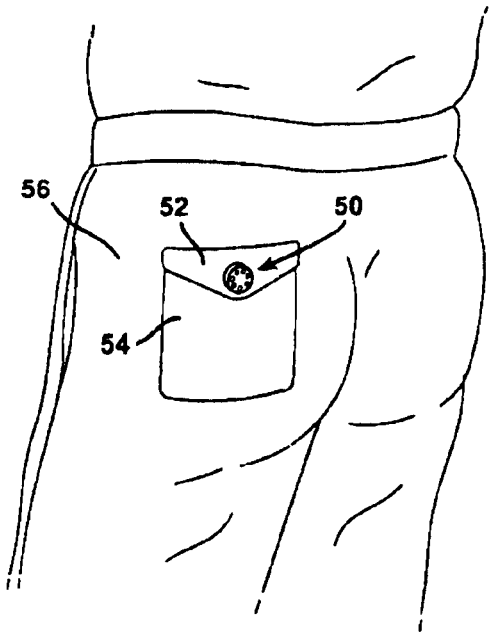
FIG. 13 is a perspective view of a third embodiment of the keyless locking device 50 in use on the flap 52 of a pocket 54.

The keyless locking device of this invention has many uses and embodiments, some of which are described herein. For example, FIG. 1 depicts one embodiment of the keyless locking device 10 in use on a zippered handbag 40. FIG. 11 depicts a second embodiment of the keyless locking device 30 in use on a handbag 40 having a closure flap 44. FIG. 13 depicts a third embodiment of the keyless locking device 50 in use on the flap 52 of a pocket 54.

Figure 2:
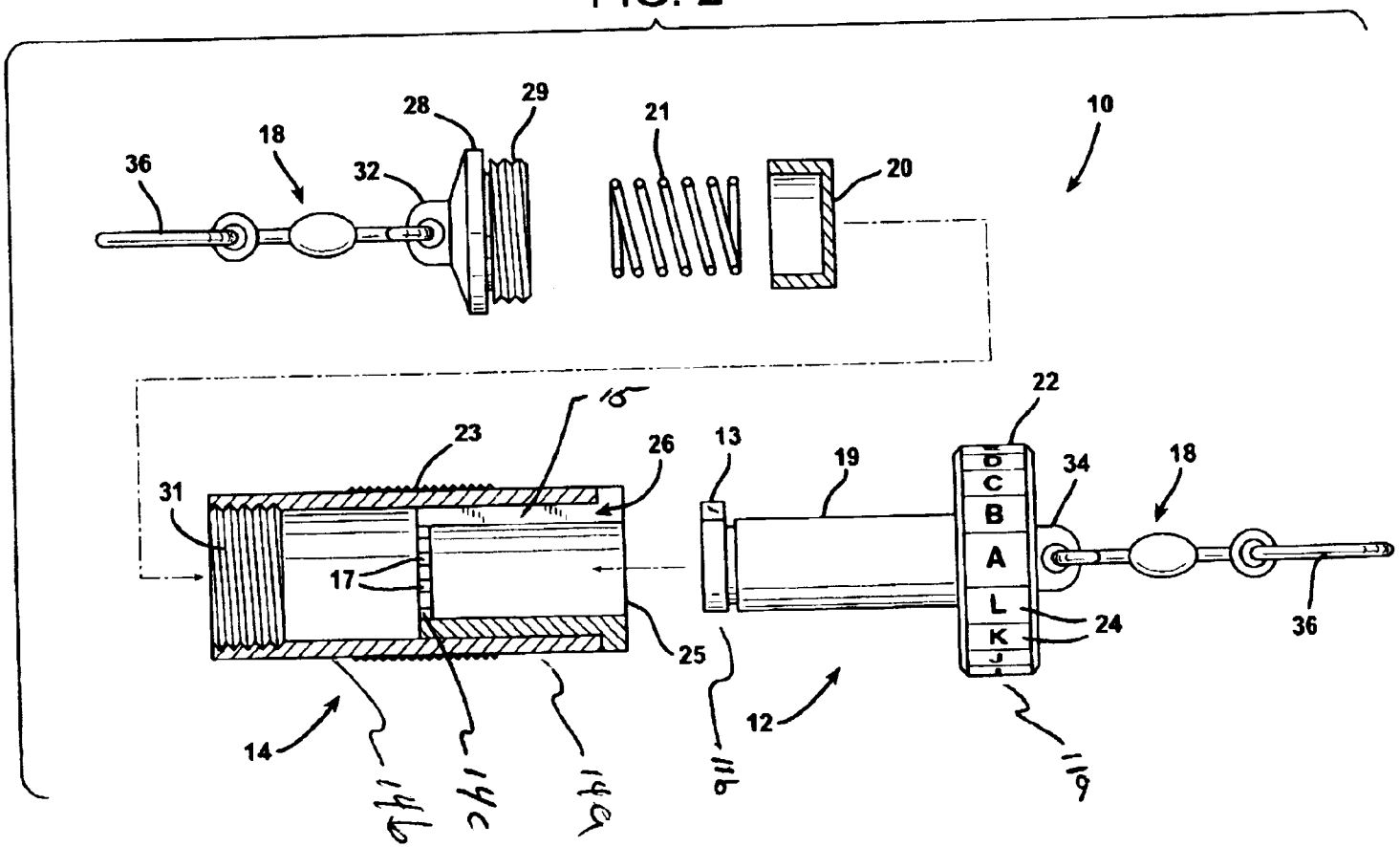
FIG. 2 is an exploded cross-sectional view of the keyless locking device 10 shown in FIG. 1.
Figure 7:
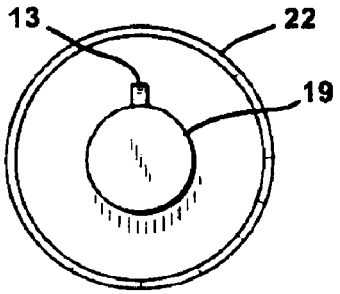
FIG. 7 is an end view of the cylindrical plunger 12 of the keyless locking device 10 shown in FIG. 1, taken along 7—7 of FIG. 8.
Figure 8:
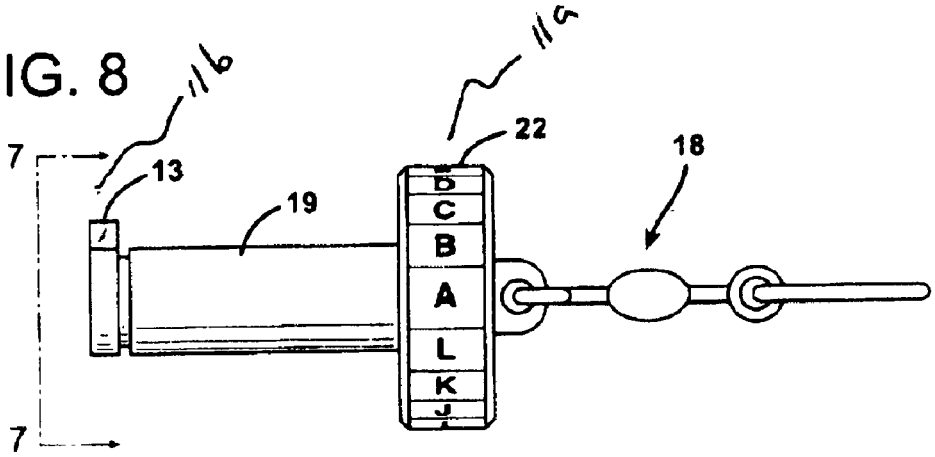
FIG. 8 is a side view of the cylindrical plunger 12 of the keyless locking device 10 shown in FIG. 1.

Referring, for example, to the keyless locking device 10 depicted in FIGS. 1–10, the device comprises a cylindrical plunger 12 having a shaft 19. The plunger 12 has a near end 11*a* and a distal end 11*b*. Referring to FIGS. 2, 7 and 8, a key 13 is on shaft 19, near or at the distal end 11*b*. The key 13 projects radially outward from the shaft 19. The key 13 is at a prescribed distance from the near end 11*a* and at an axial location about the circumference of the shaft 19 (see FIG. 7).

The locking device 10, further includes a cylindrical sleeve 14 for releasably and rotatably receiving the plunger 12. The sleeve 14 has an open top portion 14*a*, a bottom portion 14*b* and a circumferential lip 14*c* within the sleeve 14 separating the top 14*a* and bottom portions 14*b*. Preferably, the bottom portion 14*b* is closed. Referring to FIGS. 2–6, exemplary of all of the embodiments depicted herein, the bottom portion 14*b* is closed by a removable end cap 28 having external threads 29 that threadably engage with internal threads 31 on the bottom portion 14*b*. In the embodiment depicted in FIGS. 1–10, the end cap 28 has mounted thereto an attachment member 32 which can further have attached thereto a swivel connecter 18 and attachment rings 36 to permit, as shown in FIG. 1, the rotatable attachment of the bottom portion 14*b* of the keyless locking device 10 to a location on the handbag 40 where the locking device 10 is needed, i.e., near the end of the slide fastener or zipper 16.

Likewise, in the embodiment depicted in FIGS. 1–10, the near end 11*a* of the plunger has mounted thereto an attachment member 34 which can further have attached thereto a swivel connecter 18 and attachment rings 36 to permit, as shown in FIG. 1, the rotatable attachment of the plunger 12 of the keyless locking device 10 to the slider 38 of the slide fastener or zipper 16.

Figure 9:
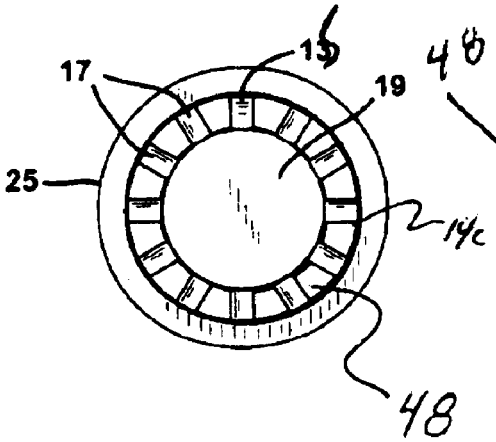
FIG. 9 is an end view of the capture sleeve 14 of the keyless locking device 10 shown in FIG. 1, taken along 9—9 of FIG. 10.
Figure 10:
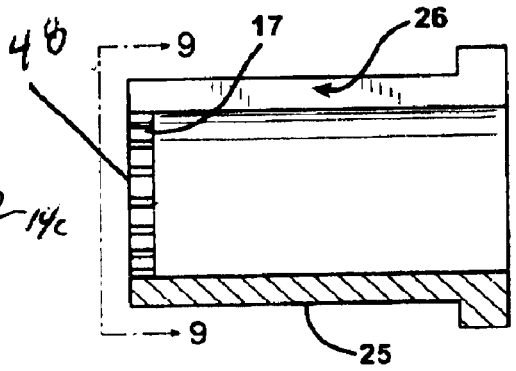
FIG. 10 is a side view of the capture sleeve 14 of the keyless locking device 10 shown in FIG. 1.

Referring to FIGS. 2, 9 and 10, the lip 14*c* has a bottom surface 48. An axially disposed keyway 15 is provided in the key retainer sleeve 25. The keyway 15 passes through the top portion of the sleeve 25, i.e., key way opening 26, and through the lip 14*c*. The keyway 15 and key 13 on the plunger shaft 19 are shaped and positioned to slidably mate with each other as the plunger 12 and sleeve 14 coact with each other.

It is highly preferable that the bottom surface of the lip 48 has a plurality of key grooves 17 formed therein around the circumferences of the lip 14*c*. The key grooves 17 are shaped to retain the key 13 therein when biased upwards by spring 21. Such an arrangement makes it more difficult to unlock the plunger 12 from the sleeve 14. The plunger 12 and sleeve 14 must be forced together against spring 21 so that the key 13 clears the key grooves 17 to permit rotation to align the key 13 and keyway 15 to enable removing the plunger 12 from the sleeve 14.

In one preferred embodiment, depicted in FIGS. 1–10, numbered or lettered indicia 24 are circumferentially disposed about the dial 22 that is attached to the shaft 19 of the near end 11*a* of plunger 12. The dial 22 may be gripped to rotate the plunger 12. The sleeve is also provided with a knurled gripping surface 23 to facilitate use of the device.

In other embodiments, depicted in FIGS. 11–12 and FIGS. 13–14, and as shown in the latter figures, numbered or lettered indicia 51 are circumferentially disposed about sleeve 14'. The sleeve 14' has a knurled gripping surface to facilitate use of the device.

In the embodiment depicted in FIGS. 1–10, a known indicium (E in this case) is substantially axially aligned with the location of the key 13. In the other embodiments, depicted in FIGS. 11–12 and FIGS. 13–14, the known indicium is substantially axially aligned with the location of the keyway 15'.

Referring to FIGS. 1–10, the distance between the key 13 and the near end 11*a* of the plunger 12 is sufficient to permit the key 13 to extend into the bottom portion 14*b* below the lip 14*c* and maintain the near end of the plunger 11*a*, 22 outside the sleeve 14. A spring member 21, preferably a coiled spiral spring, is provided within the bottom portion 14*b* of the sleeve 14, the bottom end in contact with and enclosed in the end cap 28 and the upper end in contact with and enclosed in a spring cap 20 within the bottom portion 14*b* of the sleeve 14. The spring 21 is compressed when the distal end 11*b* of the plunger slips below the bottom surface 48 of the lip 14*c* and pushes the spring cap 20. This biases the distal end 14*b* of the plunger 14 upward, forcing the key 13, after the plunger 12 is rotated with respect to the sleeve 14 and released, in mating contact with a key groove 17.

Figure 3:
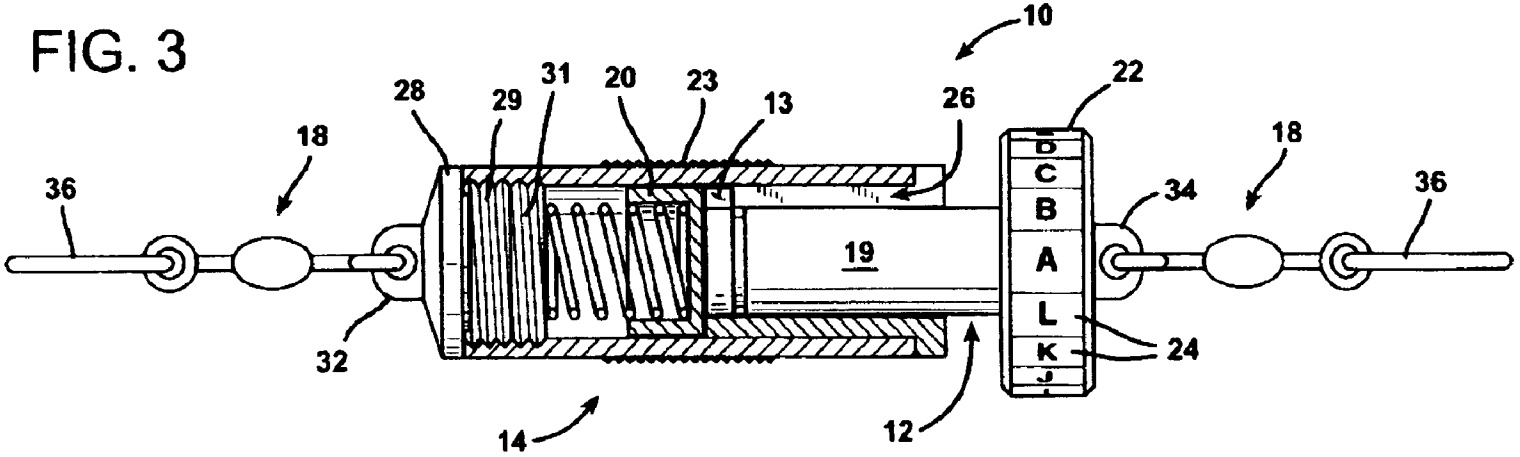
FIG. 3 is a cross-sectional view of the keyless locking device 10 shown in FIG. 1 assembled and in the unlocked position.
Figure 4:
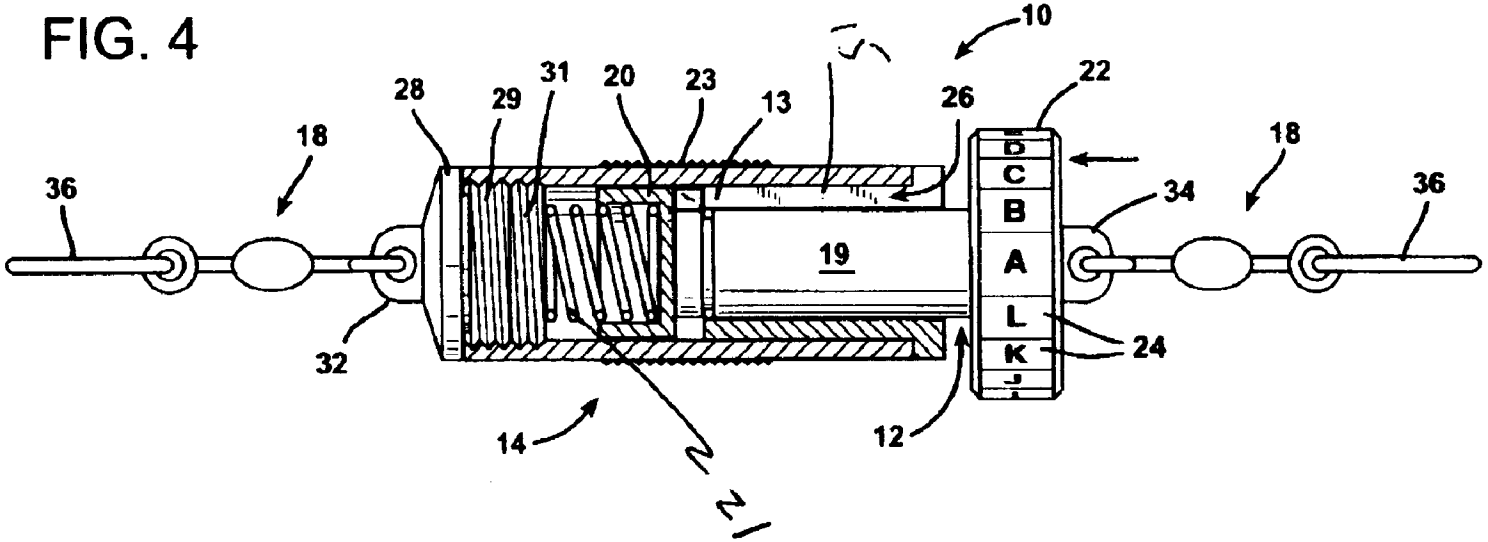
FIG. 4 is a cross-sectional view of the keyless locking device 10 shown in FIG. 1 assembled and in the locked position.
Figure 5:
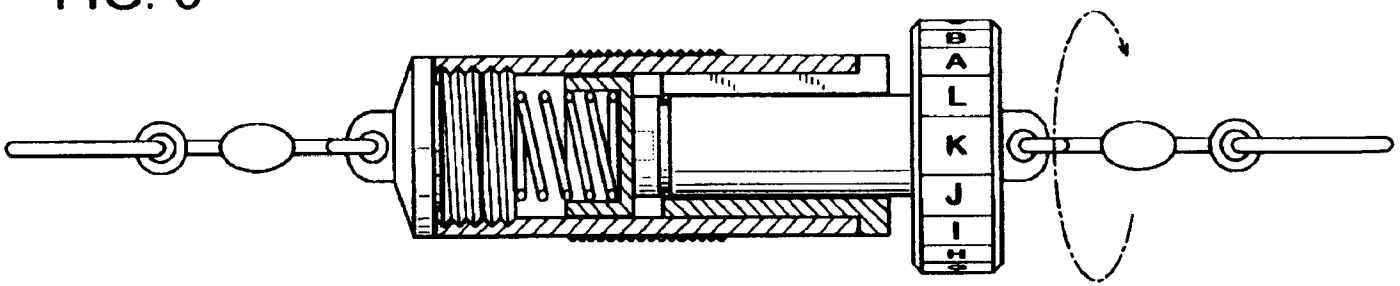
FIG. 5 and FIG. 6 are cross-sectional views of the keyless locking device 10 shown in FIG. 1 assembled and in the locked position indicating the manner of unlocking the device.
Figure 6:
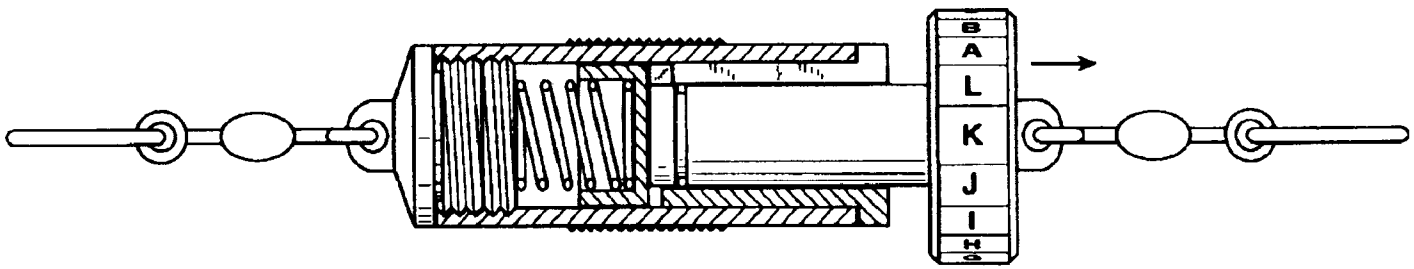

Referring to FIGS. 3–6, in order to lock the device 10, the plunger 12 is inserted into the sleeve 14, the key 13 sliding along the keyway 15 through the lip 14*c* into the bottom portion 14*b* of the sleeve 14 (FIG. 3 and FIG. 4). The distal end 11*b* of the plunger 12 in contact with cap 20 causes the spring to compress. Subsequently, the sleeve 14 and plunger 12 are rotated with respect to each other by gripping the knurled gripping surface 23 and dial 22 and then releasing it (FIG. 5).

In the embodiments depicted in FIGS. 11–14, the plunger 12' is fixed and therefore need not be gripped to rotate. After release, the spring member 21 biases the plunger 12 and the attached key 13 upward and locks the key 13 onto the bottom surface 48 of the lip 14*c*. It is preferred in all the embodiments, that the key 13 mates with a key groove 17 to prevent easy rotation of the plunger 12 with respect to the sleeve 14 and thus prevent inadvertent or easy unlocking by a pick pocket.

Again referring to FIGS. 1–10, in order to unlock the device 10, the sleeve 14 and plunger 12 are pressed together and rotated with respect to each other until the key and keyway are aligned with respect to each other by noting the position of the known indicium (E) with respect to the keyway opening 26 or an indicium that marks the location of the keyway 15. The plunger 12 is then removed from the sleeve 14, the key 13 sliding along the keyway 15 through the lip 14*c* and into the top portion 14*a* of the sleeve 14.

As depicted in FIGS. 1–10, the locking device 10 may, for example, be conveniently used to lock a handbag 40 in the closed position by rotatably attaching one of the sleeve or plunger (in this case the plunger 12) to the zipper grasp 36 and the other to the handbag 40 near the position the grasp 36 when the zipper is closed.

Figure 12:
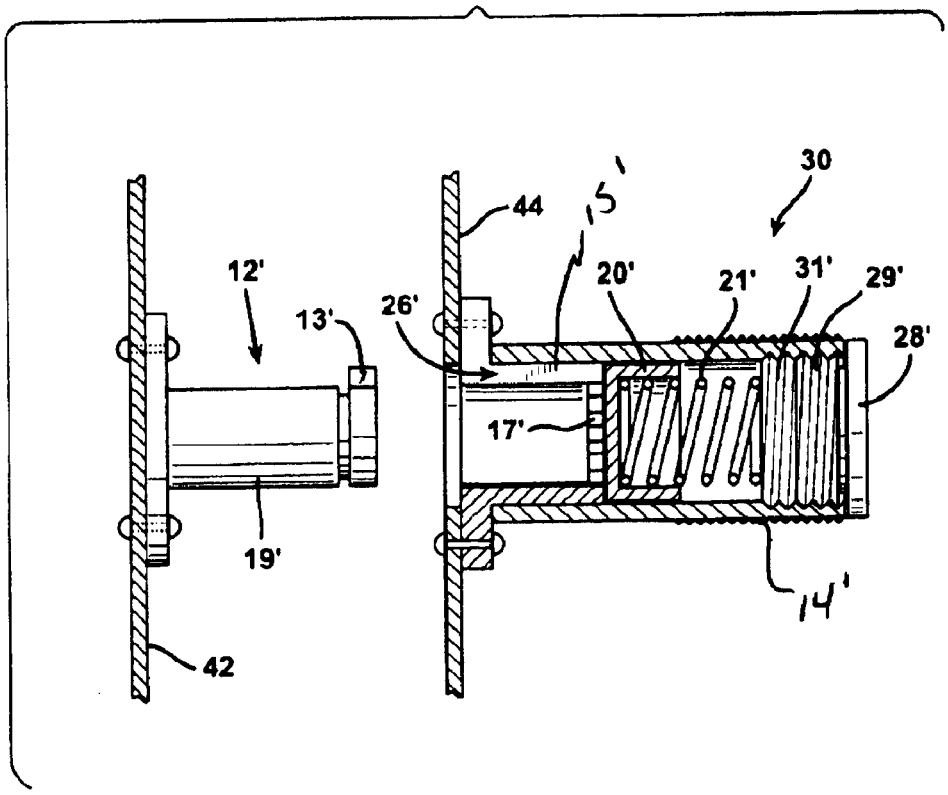
FIG. 12 is an exploded cross-sectional view of the keyless locking device 30 shown in FIG. 11.
Figure 14:
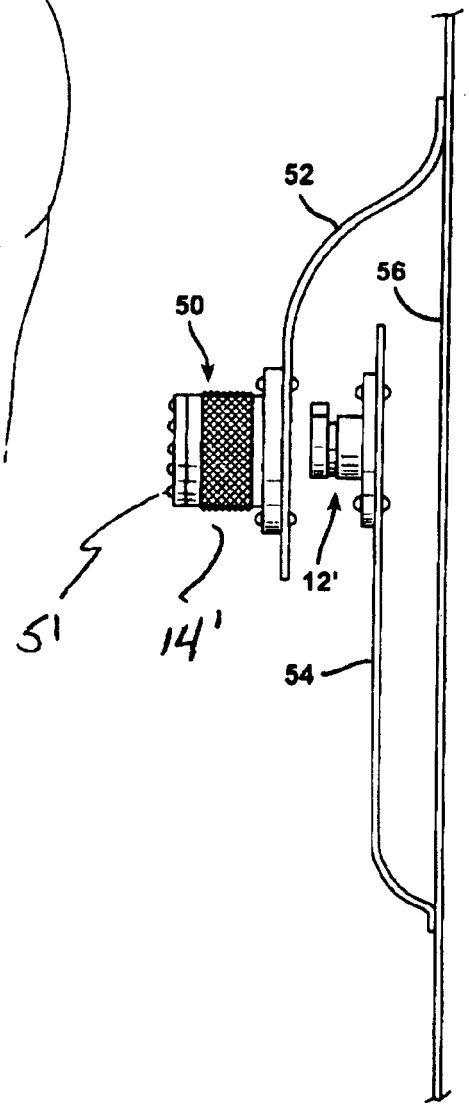
FIG. 14 is an exploded cross-sectional view of the keyless locking device 50 shown in FIG. 13.

In other embodiments, as depicted in FIGS. 11–14, either the plunger or sleeve may be permanently affixed to the device to be locked. More specifically, FIG. 11 and FIG. 12 depict the keyless locking device 30 in use on a handbag 40 having a closure flap 44. In this embodiment the sleeve 14' that is attached to the closure flap 44 is placed onto a plunger 12' that is affixed to the side 42 of the bag 40 and the sleeve 14' maneuvered appropriately with respect to the plunger 12'. In FIG. 13 and FIG. 14, the keyless locking device 50 is shown in use pocket 54 attached to slacks 56. The pocket 54 has a closure flap 52. In this embodiment the sleeve 14' that is attached to the closure flap 52 is placed onto the plunger 12' that is affixed to the pocket 54 and the sleeve 14' maneuvered appropriately with respect to the plunger 12'.

The locking device of the invention is particularly suited for use in connection with handbags or luggage that includes a slide fastener or zipper as the closure for the case. The device is suitable for a number of applications in addition to the illustrated applications, for example, in garment bags, briefcases, women's handbags, pocket books, men's wallets, fanny packs, pack sacks, backpacks, waist and shoulder bags and other carrying units or receptacles.

The novel locking device of this invention is particularly useful in that it is pickpocket resistant. It is a deterrent for pickpockets because the device requires prior knowledge of the code and mechanism for opening on the first attempt and requires specific hand motions and actions that are difficult for pickpockets.

While various changes may be made in the detailed construction and processes of this invention, it will be understood that such changes will be within the spirit and scope of the present invention. Having thus described the invention in detail, it is to be understood that the foregoing description is not intended to limit the spirit and scope thereof. What is desired to be protected by Letters Patent is set forth in the appended claims.

What is claimed is:

1. A keyless locking device comprising:

a cylindrical plunger having a near end and a distal end and a key thereon a distance from the near end and at a location about the circumference of the plunger;

a cylindrical sleeve for releasably and rotatably receiving the plunger, having an open top portion, a bottom portion and a circumferential lip fixedly mounted within the sleeve separating the top and bottom portions, the lip having a bottom surface;

a keyway axially disposed within the sleeve passing through the top portion of the sleeve and through the lip, the key slidably mating with the keyway;

at least one indicium circumferentially disposed about one of the sleeve or the near end of the plunger, including one known indicium being substantially axially aligned with the location of the keyway if on the sleeve or substantially axially aligned with the location of the key if on the plunger;

wherein the distance between the key and near end of the plunger is sufficient to permit the key to extend into the bottom portion below the lip and maintain the near end of the plunger outside the sleeve;

a spring member within the bottom portion that is compressed when in contact with the distal end of the plunger, biasing the plunger upward;

whereby to lock the device the plunger is inserted into the sleeve, the key sliding along the keyway through the lip into the bottom portion, the distal end compressing the spring member, and then the sleeve and plunger are rotated with respect to each other and released, the spring biasing the plunger upward and locking the key onto the bottom surface of the lip;

whereby to unlock the device the sleeve and plunger are pressed together, the distal end compressing the spring member, and rotated with respect to each other until the one known indicium is aligned, respectively, with the key or keyway, the spring biasing the plunger out of the sleeve, and then the plunger is removed from the sleeve, the key sliding along the keyway through the lip and into the top portion for removal.

2. A keyless locking device comprising:

a cylindrical plunger having a near end and a distal end and a key thereon a distance from the near end and at a location about the circumference of the plunger, indicia circumferentially disposed about the near end of the plunger, including one known indicium being substantially axially aligned with the location of the key;

a cylindrical sleeve for releasably and rotatably receiving the plunger, having an open top portion, a bottom portion and a circumferential lip fixedly mounted within the sleeve separating the top and bottom portions, the lip having a bottom surface;

a keyway axially disposed within the sleeve passing through the top portion of the sleeve and through the lip, the key slidably mating with the keyway when the plunger is inserted into the sleeve;

wherein the distance between the key and near end of the plunger is sufficient to permit the key to extend into the bottom portion below the lip and maintain the near end of the plunger outside the sleeve;

a spring member within the bottom portion that is compressed when in contact with the distal end of the plunger, biasing the plunger upward;

whereby to lock the device the plunger is inserted into the sleeve the key sliding along the keyway through the lip into the bottom portion, the distal end compressing the spring, and then the plunger is rotated and released, the spring biasing the plunger upward and locking the key onto the bottom surface of the lip;

whereby to unlock the device the plunger is pushed into the sleeve, the distal end compressing the spring member, and rotated until the one known indicium is aligned with the keyway, the spring biasing the plunger out of the sleeve, and the plunger is then removed, the key sliding along the keyway through the lip and into the top portion for removal.

3. A keyless locking device comprising:

a cylindrical plunger having a near end and a distal end and a key thereon a distance from the near end and at a location about the circumference of the plunger;

a cylindrical sleeve for releasably and rotatably receiving the plunger, having an open top portion, a bottom portion and a circumferential lip fixedly mounted within the sleeve separating the top and bottom portions, the lip having a bottom surface;

a keyway axially disposed within the sleeve passing through the top portion of the sleeve and through the lip, the key slidably mating with the keyway when the sleeve is placed on the plunger;

indicia circumferentially disposed about the sleeve, including one known indicium being substantially axially aligned with the location of the keyway;

wherein the distance between the key and near end of the plunger is sufficient to permit the key to extend into the bottom portion below the lip and maintain the near end of the plunger outside the sleeve;

a spring means within the bottom portion that is compressed when in contact with the distal end of the plunger, biasing the plunger upward;

whereby to lock the device the sleeve is placed on the plunger, the key sliding along the keyway through the lip into the bottom portion, the distal end compressing the spring member, and then the sleeve is rotated and released, the spring member biasing the plunger upward and locking the key onto the lower surface of the lip;

whereby to unlock the device the sleeve is pushed onto the plunger, the distal compressing the spring member, and rotated until the one known indicium is aligned with the key, the spring biasing the plunger out of the sleeve, and then the sleeve is removed, the key sliding along, the keyway through the lip and into the top portion for removal.

4. The locking device of claim 1, wherein the key is at the distal end of the plunger.

5. The locking device of claim 1, wherein the bottom portion is closed by a cap.

6. The locking device of claim 1, wherein the bottom portion is closed by a cap and the spring member is in contact therewith.

7. The locking device of claim 5, wherein the cap is removably mounted to the bottom portion.

8. The locking device of claim 5, wherein the cap has an attachment means for rotatably attaching the sleeve of the locking device to an article that requires locking.

9. The locking device of claim 8, wherein the near end of the plunger has an attachment means for rotatably attaching the plunger of the locking device to an article that requires locking.

10. The locking device of claim 1, wherein the near end of the plunger has an attachment means for rotatably attaching the plunger of the locking device to an article that requires locking.

11. The locking device of claim 1, wherein the lower surface of the lip has a plurality of key grooves therein that substantially mate with the key when the plunger is biased upward.

12. The locking device of claim 2, wherein the lower surface of the lip has a plurality of key grooves therein that substantially mate with the key when the plunger is biased upward.

13. The locking device of claim 3, wherein the lower surface of the lip has a plurality of key grooves therein that substantially mate with the key when the plunger is biased upward.

* * * * *